US005299767A

United States Patent [19]

Simpson, deceased

[11] Patent Number: 5,299,767

[45] Date of Patent: Apr. 5, 1994

[54] PRESSURE WASHER FRAME HAVING GUNVALVE AND HOSE RACK

[75] Inventor: John A. Simpson, deceased, late of Clearwater, Fla., by Betty L. Simpson, Executrix

[73] Assignee: Simpson Cleaning Systems, Inc., Clearwater, Fla.

[21] Appl. No.: 990,150

[22] Filed: Dec. 14, 1992

[51] Int. Cl.[5] ..... A47K 1/04

[52] U.S. Cl. ..... 248/129; 239/175; 239/526

[58] Field of Search ..... 239/175, 526; 248/129, 248/75, 80, 79, 89, 91, 316.6, 67.7, 76, 77, 78, 81, 82, 90

[56] References Cited

U.S. PATENT DOCUMENTS

| | | | |
|---|---|---|---|
| 3,023,969 | 3/1962 | Hudson et al. | 248/129 X |
| 3,065,765 | 11/1962 | Cailas | 248/75 X |
| 3,119,587 | 1/1964 | Anderson | 248/75 |
| 3,940,065 | 2/1976 | Ware et al. | 239/526 X |
| 4,222,145 | 9/1980 | Lowder | 248/129 X |
| 5,064,123 | 11/1991 | Aiello et al. | 239/526 X |
| 5,106,020 | 4/1992 | Harrell | 239/532 X |
| 5,190,218 | 3/1993 | Kayser et al. | 239/175 X |

*Primary Examiner*—Ramon O. Ramirez

*Attorney, Agent, or Firm*—Joseph C. Mason, Jr.; Ronald E. Smith

[57] ABSTRACT

A pressure washer frame is modified to include a hose reel and a gunvalve rack so that those items can be transported to a job site with the pressure washer. The hose reel is created by connecting a stop member to the conventional handle with a pair of brackets so that a hose can be coiled about the handle and held against slippage by the stop member. The rack for the gunvalve is created by adding a pair of longitudinally spaced cradles to the frame. The first cradle is added to the handle end of the frame and supports the pistol grip part of the gunvalve. The second cradle is added to the opposite end of the frame and supports the distal end of the gunvalve. A strap associated with the second cradle holds down the distal end.

9 Claims, 2 Drawing Sheets

PRESSURE WASHER FRAME HAVING GUNVALVE AND HOSE RACK

BACKGROUND OF THE INVENTION

1. Field of the Invention

This invention relates, generally, to pressure washers. More particularly, it relates to structural improvements to pressure washer frames that enable storage of auxiliary items thereon.

2. Description of the Prior Art

Pressure washers deliver water under high pressure to a surface to be stripped, cleaned, or prepared for further treatment. Typically, they include a pump and a gasoline engine that are mounted on a frame. The frame is usually provided with a handle and wheels so that it may be transported over various surfaces.

An elongate pressure discharge hose extends from the pump, and a trigger-operated gunvalve having a pistol grip is releasably attached to the distal free end of the hose.

Since the primary function of the frame is to support the engine and the pump, and because there is no obvious way to modify the frame so that it can also support the hose and gunvalve, no practical means of modular design has ever been provided for carrying the gunvalve or the pressure discharge hose. Thus, the user of a conventional pressure washer is required to make two trips from the vehicle that carries the pressure washer to the job site; the first trip is made to wheel the pressure washer from the vehicle to the job site, and the second trip is made to carry the gunvalve and hose thereto.

Some individuals have welded various brackets onto pressure washer frames in an attempt to eliminate the second trip, but the welding process is time-consuming and inconvenient.

Pressure washers mounted on frames equipped with wheels and a handle for pushing the frame have been known for decades, but a practical means for modifying a pressure washer frame to accommodate both the gunvalve and the hose has eluded those of ordinary skill in the art. The conventional wisdom is that the status quo is acceptable, because said wisdom holds that the cost of redesigning the standard pressure washer frame so that it could carry the hose and gunvalve would probably be cost prohibitive.

SUMMARY OF THE INVENTION

The longstanding but heretofore unfulfilled need for a pressure washer frame that accommodates a gunvalve and hose is now provided in the form of a frame that has an auxiliary handle-like stop member that cooperates with the conventional handle to provide a hose storage means, and a pair of cradle members mounted at opposite ends of the frame assembly for releasably supporting the gunvalve. Thus, the extra trip for carrying the hose and gunvalve is eliminated, and the modification to the conventional frame is achieved at low cost. Significantly, both the auxiliary stop member and the cradle members are easily retrofit onto any existing pressure washer frame in the absence of welding.

The auxiliary handle-like stop member is positioned forwardly of the conventional handle and is secured thereto by a pair of unique bracket members. It is bent forwardly at approximately the same angle as the conventional handle is bent rearwardly. The pressure discharge hose is coiled around the existing handle, and the auxiliary stop member and the pair of brackets that secure it to the existing handle prevent the coiled hose from sliding down said existing handle.

A first cradle member is dedicated to the support of the proximal or pistol grip end of the gunvalve; it is secured to the outboard side of a preselected one of the first and second brackets.

A second cradle member is secured to a leading end of the frame assembly and cradles a leading end of the gunvalve; it includes a fastening means that releasably secures the leading end of the gunvalve to said second cradle. More particularly, the second cradle is secured to a tubular guard member that projects forwardly of the frame to protect the engine and other frame-carried parts of the pressure washer.

All brackets are attachable with bolts and nuts; accordingly, a conventional pressure washer frame may be retrofitted in the field with the novel parts. Moreover, the brackets are modular so that they fit pressure washer frames of all sizes. Thus, the novel parts may be sold as a kit and installed with ordinary tools.

It will thus be seen that the primary object of this invention is to advance the art of pressure washers by providing a frame having means for holding both the pressure discharge hose and the gunvalve so that all parts of the pressure washer assembly can be delivered to a job site in one trip.

Another important object is to accomplish the foregoing object with a kit having modular parts that may be retrofit to an existing pressure washer frame in the field without requiring welding or other special assembly techniques.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
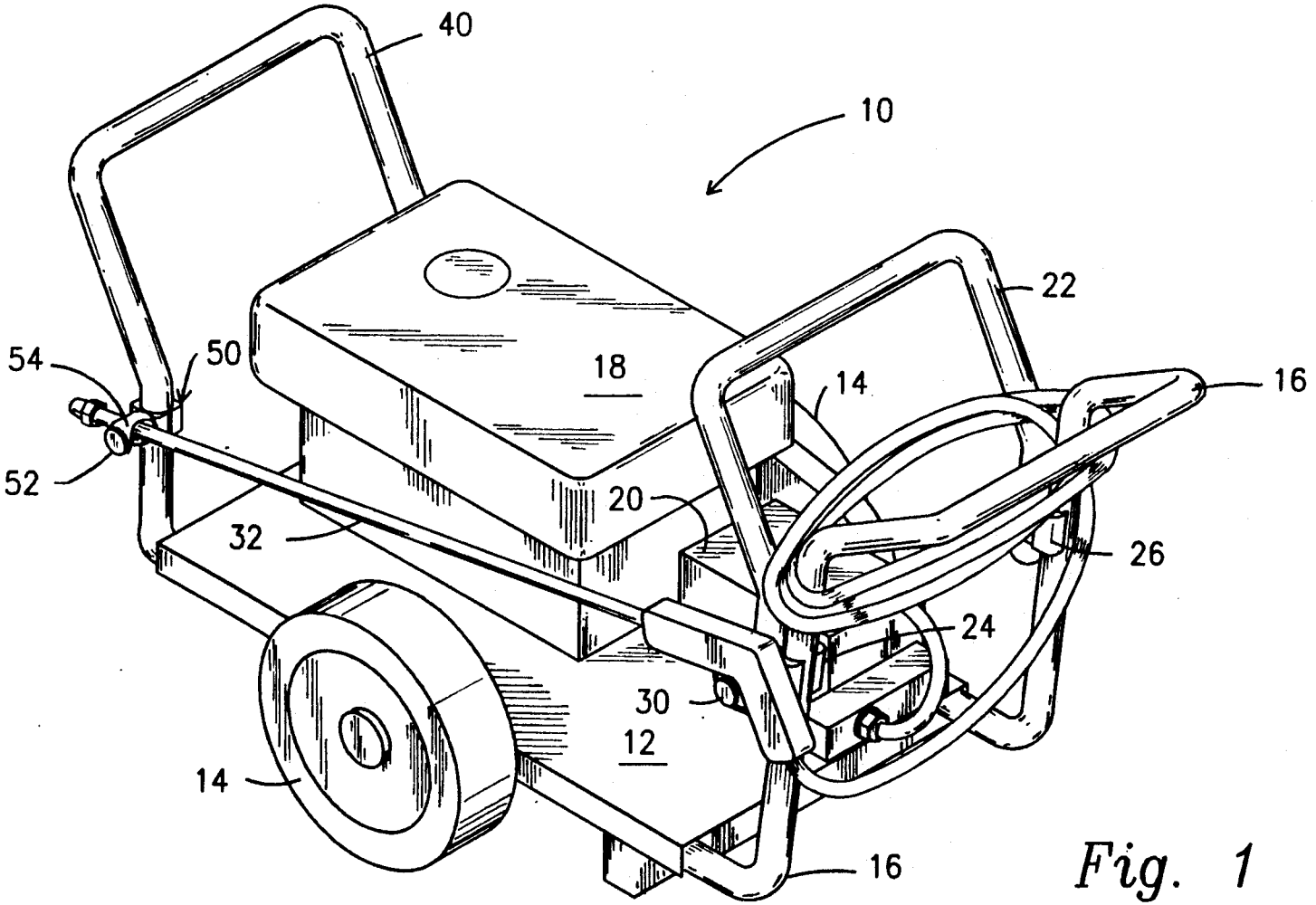
FIG. 1 is a perspective view of the novel pressure washer.

Referring now to FIG. 1, it will there be seen that the novel pressure washer is denoted 10 as a whole. It includes frame 12 supported by wheels 14, and a handle 16 at its proximal end for facilitating transportation of said frame over various support surfaces. Reference numerals 18 and 20 indicate the gasoline engine and pump, respectively.

Figure 2:
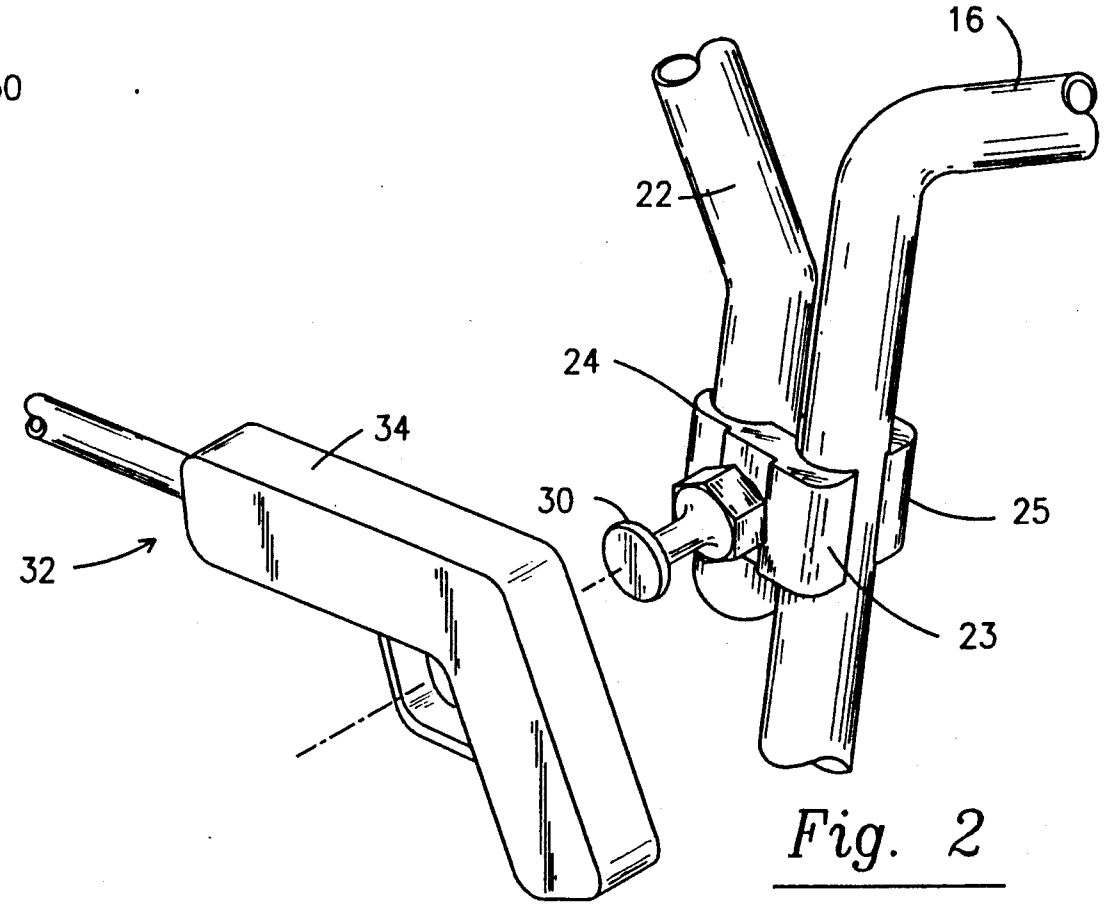
FIG. 2 is a perspective view of the bracket that secures the auxiliary stop member to the conventional handle and of the cradle for the proximal end of the gunvalve.

The auxiliary handle-like stop member that cooperates with conventional handle 16 to form a means for holding the pressure discharge hose in a coiled configuration is denoted 22 as a whole. It is a tubular member formed of the same material as handle 16, and has bends formed therein that are similar to the bends formed in said conventional handle. Stop member 22 is generally u-shaped when seen in end view. Its opposite ends are held by first and second brackets 24, 26 (FIG. 1); said brackets 24, 26 also engage handle 16 and thus serve to interlock handle 16 and stop member 22 as best shown in FIG. 2. Since handle 16 is usually one or one and one-quarter inches in diameter, brackets 24, 26 are sold in two different sizes.

More particularly, each bracket of said first and second brackets includes a first and a second part, said first and second parts being individually formed with respect to one another, and each of said first and second parts being centrally apertured to slidingly receive an elongate bolt. In FIG. 2, the first and second parts of bracket 24 are denoted 23 and 25, respectively. Bracket 26 has the same construction. An elongate bolt, preferably a machine bolt, adjustably interconnects said first and second parts 23, 25 in cooperative relation to one another, and handle 16 and stop member 22 are positioned in sandwiched relation between said first and second parts so that tightening of said bolt in the manner hereinafter described securely engages said stop member to said handle. Note that each of said first and second parts is dished to accommodate the respective tubular arms of its associated handle and stop member. Again, the size of the brackets and the radius of curvature of the dished parts will be different as between the brackets that accommodate the one inch and one and one-quarter inch diameter handles.

Stop member 22 is bent forwardly at about the same angle as handle 16 is bent rearwardly. In this manner, as best understood in connection with FIG. 1, a hose coiled around handle 16 cannot slide beyond stop member 22; thus, an important object of this invention is elegantly achieved.

A first cradle 30 has a spool or reel configuration, and is mounted to the outboard side of bracket 24 or 26. Cradle 30 has an internally threaded axial bore that screw-threadedly receives the elongate bolt that extends through the first and second parts of each bracket. Thus, the first cradle 30 serves as the nut means when brackets 24 and 26 are scoured into position. Note also that the appropriate parts of the pressure washer frame are also bored to receive the bolts. In the depicted embodiment, cradle 30 is secured to bracket 24; this mounting might be preferred for a left-handed user. Cradle 30 extends laterally outwardly with respect to handle 16 and stop member 20 and provides a cradle means for the proximal end or pistol grip part 34 of gunvalve 32.

Figure 3:
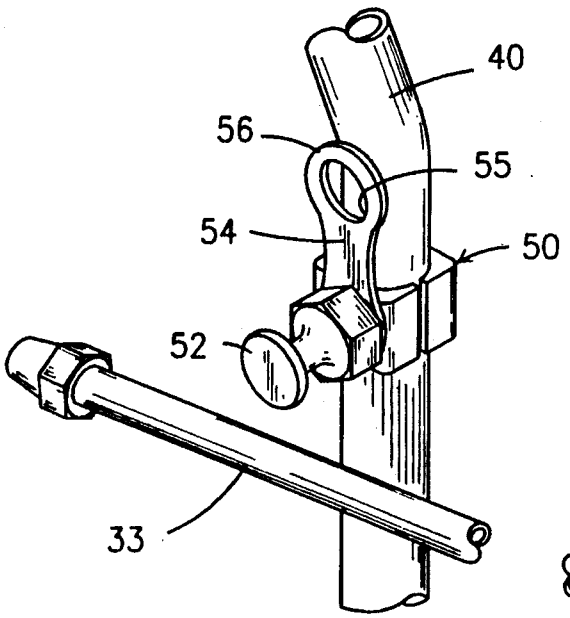
FIG. 3 is a perspective view of the cradle for supporting distal end of the gunvalve.

As shown in FIG. 1, another generally u-shaped tubular member or guard 40 is positioned at the leading end of the pressure washer frame 10; it protects the motor and other frame-carried parts as mentioned earlier. A third bracket 50, best shown in FIG. 3, is secured to a preselected leg of said guard 40. Said third bracket 50 also includes a spool-shaped cradle 52, and said cradle 52 is axially bored to screw-threadedly receive the externally threaded end of an elongate bolt that is slidingly received through a central aperture formed in each part of third bracket 50. Thus, the construction of the third bracket and the second cradle are similar to the first and second brackets and the first cradle.

Second cradle 52 cradles the leading end 33 of gunvalve 32 as shown. A flexible strap 54 has a first end releasably secured to the inboard end of third bracket 50 and includes a second, apertured free end 56 that is releasably engageable to the outboard end of said third bracket in overlying relation to said gunvalve leading end. Specifically, aperture 55 formed in the free end 56 of strap 54 releasably engages the enlarged disc-shaped outboard end of cradle 52. Strap 54 therefore maintains the leading end 33 of the gunvalve 32 on its cradle 52 even when the pressure washer 10 is being rapidly carted over an uneven surface. The proximal end 34 of the gunvalve 32 is not strapped down; its weight substantially maintains its position on cradle 30.

These unique additions to a pressure washer frame represent an important advance in the art of pressure washer frame design.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An improvement in pressure washer frames, comprising:

a frame for supporting an engine and a pump;

a handle secured to a proximal end of said frame;

a stop member;

a first and a second bracket member for securing said stop member to said handle;

each of said bracket members including a first part and a second part;

said first and second parts adapted to simultaneously engage said handle and said stop member;

interconnecting means for joining together said first and second parts in sandwiching relation to said handle and stop members;

a first cradle secured to a preselected part of a preselected bracket of said first and second brackets;

a guard secured to a distal end of said frame;

a third bracket secured to said guard;

said third bracket including a first part and a second part; and a second cradle secured to said third bracket;

whereby an elongate hose coiled about said handle is held against slippage by said stop member; and whereby opposite ends of a gunvalve are supported by said first and second cradles.

2. The improvement of claim 1, wherein said first and second parts of said first, second, and third brackets are centrally apertured, and wherein said first cradle and said second cradle are axially bored.

3. The improvement of claim 1, wherein said handle and said stop member are generally u-shaped tubular members having transversely spaced apart arms.

4. The improvement of claim 3, wherein each part of said first and second parts is dished to accommodate the tubular arm of its associated handle and stop member.

5. The improvement of claim 2, wherein said first cradle is fixedly secured to an outboard side of its associated bracket.

6. The improvement of claim 5, wherein said second cradle is fixedly secured to an outboard side of said third bracket.

7. The improvement of claim 6, further comprising a flexible strap having a first end releasably secured to an inboard end of said second cradle and an apertured distal free end releasably securable to an outboard end of said second cradle so that said strap retains said distal end of said gunvalve against movement when said distal free end of said strap is scoured to said second cradle in overlying relation to said gunvalve distal end.

8. The improvement of claim 7, wherein said first, second, and third brackets and hence said first and second cradles are secured to their respective mounts by screws and nuts.

9. The improvement of claim 7, wherein an elongate bolt slidably receives said first and second parts of a preselected bracket and screw-threadedly engages a preselected cradle, to thereby maintain said first and second parts of said preselected bracket in sandwiching relation relative to a preselected part of a pressure washer frame.

* * * * *